United States Patent [19]

Bayan

[11] Patent Number: 4,515,858

[45] Date of Patent: May 7, 1985

[54] POLYESTER HAIRBRUSH BRISTLE

[75] Inventor: Ghawamedin Bayan, Wilmington, Del.

[73] Assignee: E. I. Du Pont de Nemours and Company, Wilmington, Del.

[21] Appl. No.: 555,496

[22] Filed: Nov. 28, 1983

[51] Int. Cl.[3] ..... D02G 3/00

[52] U.S. Cl. ..... 428/364; 15/159 A; 525/444

[58] Field of Search ..... 15/159 A; 428/364, 397; 524/86, 445; 525/444

[56] References Cited

U.S. PATENT DOCUMENTS

| | | | |
|---|---|---|---|
| 3,953,394 | 4/1976 | Fox et al. | 260/40 |
| 4,069,278 | 1/1978 | Borman et al. | 260/860 |
| 4,117,194 | 9/1978 | Barbe et al. | 428/397 X |
| 4,132,707 | 1/1979 | Borman | 528/273 |
| 4,257,937 | 3/1981 | Cohen et al. | 260/40 |
| 4,279,053 | 7/1981 | Payne et al. | 15/159 A |

FOREIGN PATENT DOCUMENTS

| | | | |
|---|---|---|---|
| 1386548 | 3/1975 | United Kingdom | 260/40 |

*Primary Examiner*—Peter Feldman

[57] ABSTRACT

Monofilament brush bristle prepared from a blend of polyethylene terephthalate exhibits improved bend recovery characteristics.

2 Claims, 2 Drawing Figures

POLYESTER HAIRBRUSH BRISTLE

BACKGROUND OF THE INVENTION

In the development of synthetic filaments for the replacement of hog bristles in hair brushes, a wide variety of polymers has been explored. While oriented nylon monofilaments have been used most frequently in this application, effort has been directed toward the use of various polyesters in brush bristles to take advantage of the properties of these materials. An important characteristic for brush bristles is the ability of the bristles to retain their original shape with extended use. Typically, this retention of shape is designated as Mandrel Bend Recovery (MBR), that is, the extent to which a monofilament will recover its original configuration after being bent over a mandrel. In addition, of course, a brush bristle must exhibit satisfactory tensile strength for normal usage and good dimensional stability when exposed to elevated temperatures. Continuing effort has been directed toward the ideal balance of these properties for polyester filaments.

SUMMARY OF THE INVENTION

The instant invention provides a polyester hairbrush bristle that provides an excellent balance of properties and particularly good Mandrel Bend Recovery characteristics.

Specifically, the present invention provides a monofilament suitable for use as a hairbrush bristle having a diameter of about 5–10 mils and which is oriented about 3–5 times in the longitudinal direction, the polymeric components of the monofilament consisting essentially of, complementally, about 65–75 weight percent polybutylene terephthalate and about 35–25 weight percent polyethylene terephthalate, and wherein the monofilament exhibits a Mandrel Bend Recovery after ten cycles of at least about 80%.

DETAILED DESCRIPTION OF THE INVENTION

Figure 1:
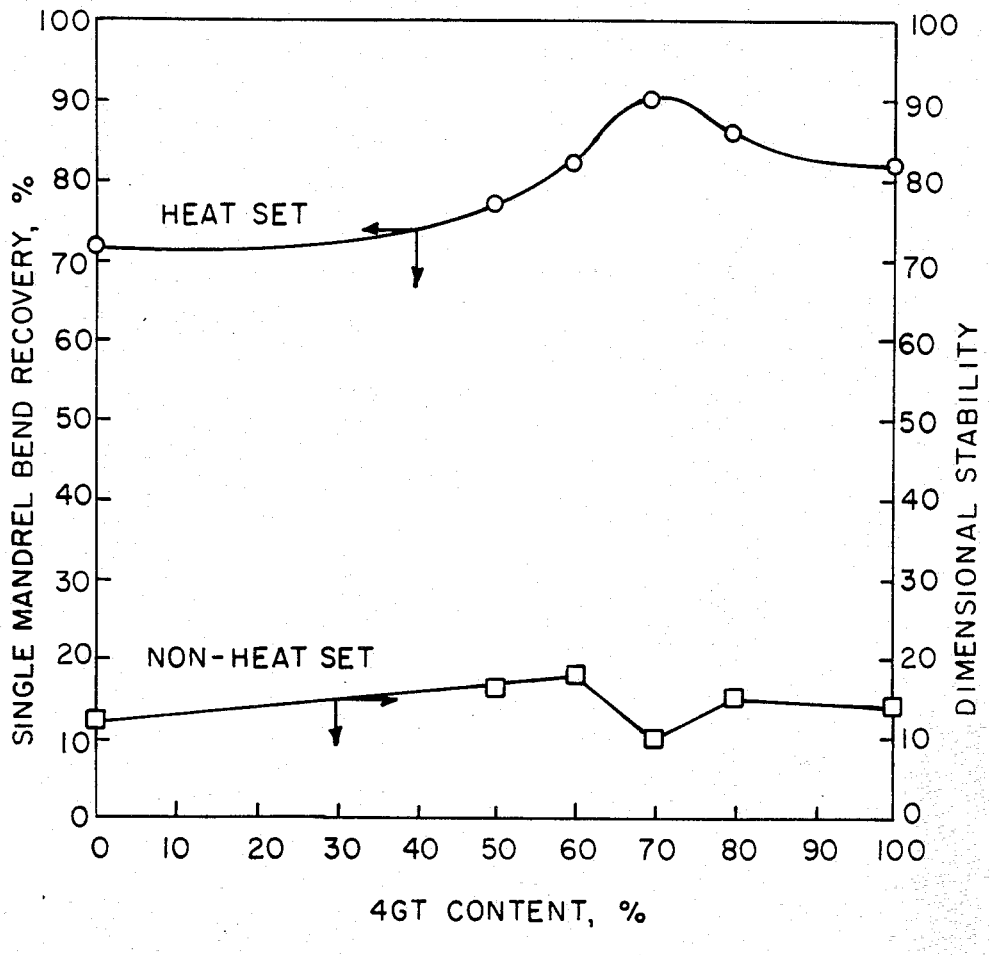
FIGS. 1 and 2 are graphical representations of the Mandrel Bend Recovery characteristics of blends of polybutylene terephthalate and polyethylene terephthalate for one and ten Mandrel Bend Recovery cycles, respectively.

The polymers used for the preparation of the present hairbrush bristles are polyethylene terephthalate and poly(1,4-butylene terephthalate). These polymers are well known as film and fiber forming materials and can be prepared by the method described in Whinfield et al. U.S. Pat. No. 2,465,319, hereby incorporated by reference. The polymers are also commercially available from a wide variety of sources.

In accordance with the present invention, the polyethylene terephthalate and polybutylene terephthalate are melt blended to provide, complementally, about 60–80% polybutylene terephthalate and about 40–20% weight percent polyethylene terephthalate. Blends having about 65–75 weight percent polybutylene terephthalate and about 35–25 weight percent polyethylene terephthalate provide still superior Mandrel Bend Recovery characteristics, and blends of about 70% polybutylene terephthalate and about 30% polyethylene terephthalate are particularly preferred. The polymers can be blended using any apparatus that will provide a substantially uniform mixture of the two components. Separate blending apparatus, such as a Banbury mixer, can be used prior to extrusion, or the polymeric components can be blended in the extrusion apparatus used for the preparation of the monofilament.

The polyethylene terephthalate and polybutylene terephthalate, in the indicated ratios, make up the whole of the polymeric components used in the present brush filaments, with the exception of minor percentages of other polymer components which do not substantially effect the overall character of the present polymer blends. However, in addition to these two polymeric components, the present filaments can contain minor quantities, for example, up to about 5 weight percent, of conventional colorants, antioxidants or processing aids such as those normally added to polymeric compositions to facilitate extrusion, as will be evident to those skilled in the art.

After blending these components, the present monofilaments are treated in the usual manner and oriented by stretching to improve tensile properties. Typically, the monofilaments are oriented by stretching about 3–5 times their original length at elevated temperatures. The orientation temperature should be above the glass transition temperature of the polyethylene terephthalate, and typically about 80°–90° C. The monofilaments are subsequently set at a temperature of about 150°–180° C., and preferably about 170° C., for a period sufficient to bring the filament to the heat setting temperature, e.g., about one minute.

The present monofilaments exhibit excellent performance characteristics as brush bristles. The oriented monofilaments show satisfactory Tensile Strength as measured by ASTM test D-638-68, combined with excellent Dimensional Stability in boiling water as measured by ASTM test D-124-54. Most importantly, the monofilaments exhibit Mandrel Bend Recovery that is noticeably better than that shown by filaments prepared from either of the two components of the polymer blend or from ratios of the two polymers outside of those specified in the present claims.

The present invention is further illustrated by the following specific examples, in which parts and percentages are by weight unless otherwise indicated. In these examples, Mandrel Bend Recovery is measured according to the following procedure:

1. Condition monofilament samples at 23±1.1° C. and 50±2% RH for 48 hours.
2. Measure the monofilament diameter to the nearest mil.
3. Attach to one end of the monofilament a weight in grams approximately equivalent to 0.5 x (diameter in mils)$^2$.
4. Insert the other end in a hole drilled in a 3/32" mandrel. Allow the monofilament and the weight to hang freely in the support.
5. Wrap 10 or more loops around the mandrel, cut off the weight, and fasten the loose end in another hole in the mandrel. Note the number of loops. Allow to stand for 4 minutes.
6. Cut the monofilment off the mandrel, place in water at 23±1.1° C., and allow to relax for 1±0.1 hour. Note the number of loops after recovery and estimate fractions of a loop to the nearest 1/10 loop.
7. Calculate Mandrel Bend Recovery according to the formula:

$$\% \text{ Recovery} = \left( \frac{\text{Initial No. of loops} - \text{No of loops after relaxing}}{\text{Initial No. of loops, step 5}} \right) 100$$

EXAMPLES 1-3 AND COMPARATIVE EXAMPLES A-C

Monofilaments were prepared from polyethylene terephthalate having an inherent viscosity of 0.72, polybutylene terephthalate having an inherent viscosity of 1.08 and commercially available from General Electric Company as "Valox 310", and blends of these two polymers. The polymers were first dry blended. The pellets were dried overnight in a 110° C. vacuum oven. The blend was then transferred to the hopper of a single-screw extruder under a nitrogen purge to maintain a dry atmosphere. Filaments were extruded with the extruder operating at a temperature ranging from 266° to 273° C. and a die temperature of 270° C. Billets were then drawn in a single-stage draw unit. The draw apparatus consisted of a pair of takeoff rolls, a pair of fast rolls, and a hot water bath. The polymers or blends, after extrusion, were drawn four times by running the fast rolls of the draw apparatus four times faster than the takeoff rolls. After orientation, the drawn filaments were heat set in a 170° C. oven for 1 minute. The oriented filament diameter was 10 mils.

Figure 2:
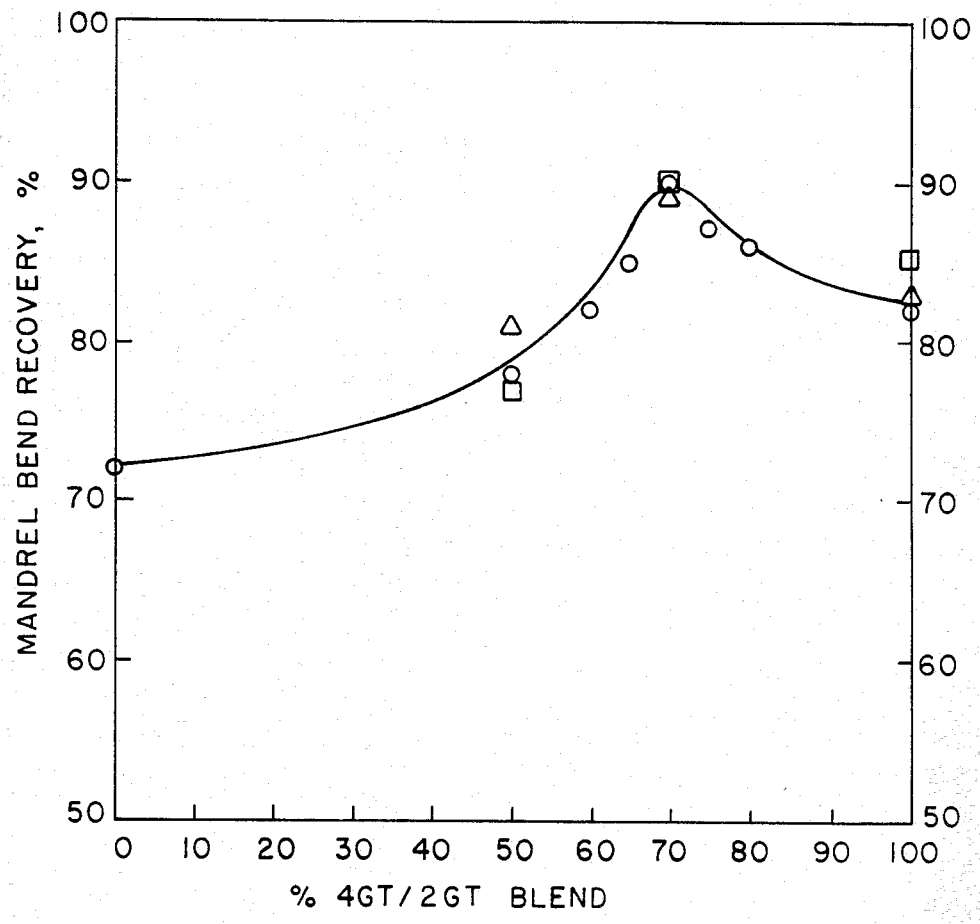

The filaments were evaluated according to the test procedures described above for Mandrel Bend Recovery, Tensile Strength and Dimensional Stability. The results are summarized in the following Table and graphically represented in the FIGS. 1 and 2 for one and ten Mandrel Bend Recovery cycles, respectively.

TABLE

| Example | Blend Comp. | MBR Cycle | MBR Values @ 5% Relax, % | Tensile Strength, Kpsi | Dimensional Stability % |
|---|---|---|---|---|---|
| A | 4GT | 1 | 82 | 43 | 1.89 |
| | | 10 | 78 | | |
| 1 | 80% 4GT | 1 | 86 | 40 | 2.33 |
| | 20% 2GT | 10 | 81 | | |
| 2 | 70% 4GT | 1 | 90 | 31 | .26 |
| | 30% 2GT | 10 | 83 | | |
| 3 | 60% 4GT | 1 | 82 | 41 | .69 |
| | 40% 2GT | 10 | 73 | | |
| B | 50% 4GT | 1 | 77 | 38 | .72 |
| | 50% 2GT | 10 | 62 | | |
| C | 2GT | 1 | 72 | 58 | .50 |
| | | 10 | 53 | | |

I claim:

1. A monofilament suitable for use as a brush bristle having a diameter of about 5-10 mils and being oriented about 3.0-5.0 times in a longitudinal direction, the polymeric components of the monofilament consisting essentially of, complementally, about 65-75 weight percent polybutylene terephthalate and about 35-25 weight percent polyethylene terephthalate, and wherein the monofilament exhibits a Mandrel Bend Recovery after ten cycles of at least about 80%.

2. A brush bristle of claim 1 consisting essentially of about 70 weight percent polybutylene terephthalate and about 30 weight percent polyethylene terephthalate.

* * * * *